US007967689B2

(12) United States Patent
Mesika

(10) Patent No.: US 7,967,689 B2
(45) Date of Patent: Jun. 28, 2011

(54) MINIATURE SPOOLING APPARATUS

(76) Inventor: Yigal Mesika, Los Angeles, CA (US)

( * ) Notice: Subject to any disclaimer, the term of this patent is extended or adjusted under 35 U.S.C. 154(b) by 590 days.

(21) Appl. No.: 12/004,656

(22) Filed: Dec. 21, 2007

(65) Prior Publication Data

US 2008/0108448 A1 May 8, 2008

Related U.S. Application Data

(63) Continuation-in-part of application No. 11/093,252, filed on Mar. 29, 2005, now Pat. No. 7,311,609.

(51) Int. Cl.
*A63J 21/00* (2006.01)
*A63J 5/00* (2006.01)

(52) U.S. Cl. ..... 472/55; 472/81

(58) Field of Classification Search ..... 472/75–84, 472/137, 51–55, 71; 242/128; 446/228, 446/229, 424, 484, 491
See application file for complete search history.

(56) References Cited

U.S. PATENT DOCUMENTS

| | | | | |
|---|---|---|---|---|
| 204,758 | A | | 6/1878 | Rice |
| 686,324 | A | | 11/1901 | McKay |
| 2,876,959 | A | * | 3/1959 | Lamb et al. ..... 414/673 |
| 3,136,496 | A | * | 6/1964 | McMartin ..... 242/420.5 |
| 3,698,546 | A | | 10/1972 | Kass |
| 3,806,054 | A | * | 4/1974 | Johnson et al. ..... 242/128 |
| 4,389,132 | A | | 6/1983 | Valadez |
| 5,584,195 | A | | 12/1996 | Liu |
| 6,209,548 | B1 | | 4/2001 | Harrison et al. |
| 6,247,864 | B1 | | 6/2001 | Walsh |
| 6,447,298 | B1 | | 9/2002 | Bhatt et al. |
| 6,601,631 | B1 | | 8/2003 | Miller et al. |
| 7,311,609 | B2 | | 12/2007 | Mesika |

OTHER PUBLICATIONS

Complaint against Defendants Sean Bogunia, Rebecca Bogunia, Sean Bogunia's Ultimate Magic Productions, LLC, (Entered: Mar. 9, 2009).
Certification as to Interested Parties filed by Plaintiff Yigal Mesika, (Entered: Mar. 9, 2009).
Notice of Related Case(s) filed by Plaintiff Yigal Mesika, (Entered: Mar. 9, 2009).
Notice to Parties of ADR Pilot Program filed. (Entered: Mar. 9, 2009).
Report on the Filing of an Action Regarding a Patent or a Trademark (Initial Notification) filed by Yigal Mesika. (Entered: Mar. 9, 2009).
Standing Order by Judge John F. Walter. (Entered: Mar. 9, 2009).

(Continued)

*Primary Examiner* — Kien T Nguyen
(74) *Attorney, Agent, or Firm* — Risso & Associates; Marcus Risso

(57) ABSTRACT

A miniature spooling apparatus is described. The miniature spooling apparatus includes a housing having a miniature motor attached within the housing. The miniature motor has a shaft extending therefrom, with a mechanically powered spool attached with the shaft. A magnet is connected with the shaft and/or the spool. An integrated circuit is connected with the motor to operate the motor. Additionally, a magnetic reed switch is connected with the integrated circuit such that as a user pulls the thread and manually rotates the item, the magnet rotates to actuate the magnetic reed switch which is connected with the integrated circuit, thereby initiating the motor to start winding the thread around the spool. When the spool is still for a predetermined amount of time, the integrated circuit is configured to turn off the motor. Additionally, the miniature spooling apparatus is housed in an item, such as a pen, to conceal the apparatus.

16 Claims, 1 Drawing Sheet

OTHER PUBLICATIONS

Proof of Service Executed by Plaintiff Yigal Mesika, (Entered: Apr. 1, 2009).
Proof of Service filed by Plaintiff Yigal Mesika, District Court's Standing Order served on Mar. 10, 2009. (Cislo, Daniel) (Entered: Apr. 1, 2009).
Answer to Complaint—(Discovery) 1 filed by defendants Sean Bogunia, Rebecca Bogunia, Sean Bogunia's Ultimate Magic Productions, LLC.(Entered:Apr. 30, 2009).
Minutes in Chambers before Judge James V. Selna: Court Order. (Entered: May 1, 2009).
Notice to Filer of Deficiencies in Electronically Filed Documents. (Entered: May 1, 2009).
Proof of Service filed by Plaintiff Yigal Mesika, of Court's Scheduling Order served on May 4, 2009. (Entered: May 5, 2009).
Joint Report Rule 26(f) Discovery Plan (Entered: May 27, 2009).
Joint ADR Pilot Program Questionnaire filed by Plaintiff Yigal Mesika, (Entered: May 27, 2009).
Answer to Complaint—First Amended filed by Defendant Sean Bogunia, Rebecca Bogunia, Sean Bogunia's Ultimate Magic Productions, LLC. (Entered: Jun. 5, 2009).
Notice to Filer of Deficiencies in Electronically Filed Documents. (Entered: Jun. 8, 2009).
Minutes in Chambers before Judge John F. Walter: (Entered: Jun. 9, 2009).
Scheduling and Case Management Order by Judge John F. Walter. (Entered: Jun. 9, 2009).
Order/Referral to ADR Pilot Program by Judge John F. Walter. (Entered: Jun. 9, 2009).
Stipulation filed by Defendants, Proposed Order Approving Filing of Second Amended Answer to Complaint. (Entered: Jun. 11, 2009).
Answer to Complaint—(Discovery) 1 Second Amended filed by Defendants Sean Bogunia, Rebecca Bogunia, Sean Bogunia's Ultimate Magic Productions, LLC. (Entered: Jun. 11, 2009).
Response by the Court to Notice to Filer of Deficiencies in Electronically Filed Documents by Deputy Clerk for Judge John F. Walter. (Entered: Jun. 12, 2009).
Answer to Complaint—(Discovery) 1 filed by Defendants Sean Bogunia, Rebecca Bogunia, Sean Bogunia's Ultimate Magic Productions, LLC. (Entered: Jun. 13, 2009).
Certification as to Interested Parties Rule 7.1-1 re: Answer to Complaint. (Entered: Jun. 13, 2009).
Notice to Filer of Deficiencies in Electronically Filed Documents. (Entered: Jun. 17, 2009).
Stipulation for Protective Order filed by Plaintiff Yigal Mesika. (Entered: Jul. 1, 2009).
Memorandum and Order by Magistrate Judge Suzanne H. Segal Re: Parties' Proposed Stipulation and Protective Order. (Entered: Jul. 8, 2009).
Corrected Stipulation for Protective Order filed by Plaintiff Yigal Mesika. (Entered: Jul. 14, 2009).
Stipulated Protective Order by Magistrate Judge Suzanne H. Segal. (Entered: Jul. 16, 2009).
Application to Substitute attorney Tracy Wells, Esq. in place of attorney Daniel M. Cislo, Esq. & Mark D. Nielsen, Esq. filed by Plaintiff Yigal Mesika. (Entered: Sep. 10, 2009).
Order by Judge John F. Walter: granting Application to Substitute Attorney. (Entered: Sep. 11, 2009).
Notice of Completion of Mediation Plaintiff Yigal Mesika. (Entered: Dec. 21, 2009).
Notice of Change of Attorney Information for attorney Tracy L Wells counsel for Plaintiff Yigal Mesika. (Entered: Jan. 5, 2010).
Joint Stipulation for Extension of Time to File Pre-Trial Conf Order and related documents due Mar. 5, 2010. (Entered: Mar. 2, 2010).
Amended Scheduling and Case Management Order by Judge John F. Walter. (Entered: Mar. 4, 2010).
Order by Judge John F. Walter, re Stipulation for Extension of Time to File, Stipulation for Trial. (Entered: Mar. 4, 2010).
Joint Witness Testimony Summaries filed by Plaintiff Yigal Mesika. (Entered: Mar. 19, 2010).
Memorandum of Contentions of Fact and Law filed by Plaintiff Yigal Mesika. (Entered: Mar. 19, 2010).
First Pretrial Stipulation regarding Exhibits filed by Plaintiff Yigal Mesika. (Entered: Mar. 19, 2010).
Stipulated Pre-Trial Facts filed by Plaintiff Yigal Mesika (Entered: Mar. 19, 2010).
Trial Brief filed by Plaintiff Yigal Mesika. (Entered: Mar. 19, 2010).
Plaintiff's Initial Proposed Findings of Fact and Conclusions of Law filed by Plaintiff Yigal Mesika (Entered: Mar. 23, 2010).
Trial Brief Supplemental filed by Plaintiff Yigal Mesika.(Entered: Mar. 23, 2010).
Plaintiff's Real-Time Reporting Requirement filed by Plaintiff Yigal Mesika. (Entered: Mar. 25, 2010).
Civil Trial Order by Judge John F. Walter. (Entered: Mar. 26, 2010).
Minutes of Pretrial Conference held before Judge John F. Walter. (Entered: Mar. 26, 2010).
Trial Brief Initial filed by Defendants Rebecca Bogunia, Sean Bogunia, Sean Bogunia's Ultimate Magic Productions, LLC. (Entered: Mar. 29, 2010).
Exhibit List Defendants suplemental filed by Defendants Rebecca Bogunia, Sean Bogunia, Sean Bogunia's Ultimate Magic Productions, LLC. (Entered: Mar. 29, 2010).
Proposed Memorandum of Contentions of Fact and Law filed by Defendants Rebecca Bogunia, Sean Bogunia, Sean Bogunia's Ultimate Magic Productions, LLC. (Entered: Mar. 29, 2010).
Declaration of Arthur Evry for Claims Construction filed by Defendants Rebecca Bogunia, Sean Bogunia, Sean Bogunia's Ultimate Magic Productions, LLC. (Entered: Mar. 29, 2010).
Witness Testimony Summaries filed by Defendant Rebecca Bogunia, Sean Bogunia, Sean Bogunis's Ultimate Magic Productions, LLC. (Entered: Mar. 29, 2010).
Witness Testimony Summaries filed by Plaintiff Yigal Mesika. (Entered: Mar. 29, 2010).
Request for Extension of Time to File Trial Exhibits filed by Defendant Rebecca Bogunia, Sean Bogunia, Sean Bogunia's Ultimate Magic Productions, LLC. (Entered: Mar. 29, 2010).
Plaintiff's Mark Up to Defendant's Proposed Findings of Fact and Law filed by Plaintiff Yigal Mesika (Entered: Mar. 30, 2010).
Order by Judge John F. Walter denying Stipulation to Continue Document Production Dates. (Entered: Mar. 30, 2010).
Plaintiff's Claim Chart for '609 Patent filed by Plaintiff Yigal Mesika (Entered: Mar. 30, 2010).
Minutes Telephonic Status Conference before Judge John F. Walter. (Entered: Mar. 31, 2010).
Minutes of in Chambers Order held before Judge John F. Walter (Entered: Mar. 31, 2010).
Elements of Defendants Affirmative Defenses (Entered: Mar. 31, 2010).
Witness List filed by Plaintiff Yigal Mesika. (Entered: Apr. 1, 2010).
Final Joint Pre-Trial Conference Order (Entered: Apr. 1, 2010).
Final Pretrial Stipulation regarding Exhibits. (Entered: Apr. 1, 2010).
Minutes Status Conference before Judge John F. Walter. (Entered: Apr. 5, 2010).
Order Dismissing Civil Action by Judge John F. Walter. (Entered: Apr. 5, 2010).
Minutes of Settlement Conference held before Judge Percy Anderson. (Entered: Apr. 5, 2010).
Report on the Determination of an Action Regarding a Patent or Trademark. (Entered: Apr. 16, 2010).
Notice of Motion and Motion for Attorney Fees denial filed by Defendants Rebecca Bogunia, Sean Bogunia, Sean Bogunia's Ultimate Magic Productions, LLC. (Entered: Apr. 22, 2010).
Notice of Motion and Amended Motion for Attorney Fees filed by Defendants Rebecca Bogunia, Sean Bogunia, Sean Bogunia's Ultimate Magic Productions, LLC. (Entered: Apr. 22, 2010).
Notice of Motion and Motion for Attorney Fees filed by Plaintiff Yigal Mesika. (Entered: Apr. 22, 2010).
Declaration of Tracy Wells in Support of Plaintiff'S Motion filed by Plaintiff Yigal Mesika. (Entered: Apr. 22, 2010).
Notice of Manual Filing filed by Plaintiff Yigal Mesika of Motion to Seal. (Entered: Apr. 22, 2010).
Motion and Memorandum in Support of Motion to File Under Seal Exhibit "F" to the Declaration of Tracy L. Wells, filed by plaintiff Yigal Mesika. (Entered: Apr. 26, 2010).

Denied by Order of United States District Judge John F. Walter, re Motion and Memorandum in support of Motion to File Under Seal (Entered: Apr. 27, 2010).
Order by Judge John F. Walter regarding attorneys fees. (Entered: Apr. 27, 2010).
Opposition to Motion for Attorney Fees. (Entered: May 3, 2010).
Request for Judicial Notice re Motion for Attorney Fees. (Entered: May 3, 2010).
Reply Motion for Attorney Fees filed by Plaintiff Yigal Mesika. (Entered: May 10, 2010).
Minutes in Chambers by Judge John F. Walter: Order Denying Plaintiff's Motion to Find this case exceptional and to Award Attorneys' Fees and Expenses. (Entered: May 11, 2010).
Amended Minutes in Chambers by Judge John F. Walter: Order Denying Plaintiff's Motion to Find this case exceptional and to Award Attorneys' Fees and Expenses. (Entered: 05/12/.
"Invisible Thread Reel", 1 page, http://www.thisismagic.com/html/kevlar_micro_itr.html, 2008.
"Ultimate Float Controller", 3 pages, http://www.kwmagic.com/index.php?main_page=product_info&products_id=2480, 2008.
"Stealth Retractor", 1 page, http://www.johnkennedymagic.com/scripts/prodView.asp?idproduct=47, 2009.
"FISM Flash", 1 page, http://www.martinsmagic.com/?html=full&nav1=collection&key=937, 2000.

* cited by examiner

MINIATURE SPOOLING APPARATUS

PRIORITY CLAIM

The present application is a Continuation-in-Part patent application, claiming the benefit of priority of U.S. Non-Provisional application Ser. No. 11/093,252, filed on Mar. 29, 2005, now U.S. Pat. No. 7,311,609 entitled, "Miniature Spooling Apparatus."

BACKGROUND OF THE INVENTION (1) Field of Invention

The present invention relates to props and gimmicks used in the field of magic to create a variety of illusions and, more particularly, to a invisible thread reel prop that includes a miniature spooling apparatus with an internal motor that is operated by a switch.

(2) Description of Related Art

The present invention relates to props and gimmicks used in the field of magic, carried on the person or hidden in the clothing of the magician, and used to create the illusion of controlling an object with no visible means to do so. This type of product is generally referred to as an invisible thread reel (ITR). There are typically two different types of ITR's available.

The majority of traditional ITR's use a rubber band (internally secured on two sides with a spooler fastened around the middle) to provide tension to the thread. When the thread is extended, it unwinds and causes the spooler to rotate and the rubber band to twist. The uses and applications for this type of ITR are limited by the fact that the tension varies according to the amount of twist in the rubber band because the thread never has an even amount of tension.

A few motorized ITR's have been developed over the years but they have minimal directional control over the thread. Additionally, concealment of the product is also difficult. These issues are due to a combination of spooler placement (typically located in the center of the devices) and the opening that the thread moves through (which is not typically adjustable). Both of these drawbacks cause difficulty for the magician during operation and limit the number of ways that they can be used during a performance.

Thus, a continuing need exists for a miniature spooling apparatus that provides an even and consistent thread tension, that is adjustable, and that can be easily concealed.

SUMMARY OF INVENTION

The present invention relates to a miniature spooling apparatus. The miniature spooling apparatus comprises a housing having a miniature motor attached with the housing. A shaft extends from the miniature motor. A mechanically powered spool is attached with the shaft of the miniature motor. Thus, the miniature motor is connected with the spool for powering the spool to wind thread around the spool. A control circuit (i.e., microchip, integrated circuit (IC), discrete component) is connected with the motor and configured to cause the motor to start winding the thread around the spool and also configured to cause the motor to stop winding the thread around the spool. It should be noted that although listed herein as a microchip, the microchip is an IC, electric circuit, or discrete component.

In yet another aspect, a battery is encased within the housing and connected with the integrated circuit for powering the integrated circuit and the miniature motor.

In another aspect, a magnetic reed switch is connected with the integrated circuit, such that upon actuation of the magnetic reed switch, the motor is initiated to cause the motor to start winding the thread around the spool.

In another aspect, a magnet is attached with the spool and/or the shaft, such that as a user pulls the thread and manually rotates the item, the magnet rotates to actuate the magnetic reed switch which is connected with the integrated circuit, thereby initiating the motor to start winding the thread around the spool.

In another aspect, when the spool is still for a predetermined amount of time, the integrated circuit is configured to turn off the motor.

Additionally, the integrated circuit is further configured to determine when the motor is rotating freely, such that as the motor rotates freely for a predetermined amount of time, the integrated circuit is configured to turn off the motor.

In another aspect, the housing is shaped to resemble a barrel of a writing utensil with the miniature motor and integrated circuit encased therein. Additionally, a writing tip is attached with the housing to allow a user to write upon a surface. Further, a twistable writing tip housing is included for attaching with the housing and encasing the writing tip therein. The twistable writing tip housing is operable for extending the writing tip beyond the writing tip housing to allow a user to write with the writing tip and also for retracting the writing tip within the writing tip housing to conceal the writing tip.

In another aspect, the present invention includes a cover apparatus with an open end. The cover apparatus is formed such that it covers a portion of the mechanically powered spool and is attached with the housing such that a space exists between the cover apparatus and the spool to allow for rotation of the spool therein.

Additionally, the spool includes a rotational axis and the cover apparatus is attached with the housing such that it is rotatable in relation to the housing about a rotational axis. The cover apparatus is attached with the housing such that its rotational axis is approximately parallel to the rotational axis of the spool. The notch is formed in the cover apparatus such that when thread is spooled from the spool and through the notch, rotation of the cover apparatus allows a user to control a direction in which the thread spools.

In yet another aspect, a wireless receiver is attached with the integrated circuit. The integrated circuit is configured to receive a signal from a wireless transmitter to cause the motor to turn on and off.

Finally, as can be appreciated by one in the art, the present invention also comprises a method for forming and using the miniature spooling apparatus described herein.

BRIEF DESCRIPTION OF THE DRAWINGS

The objects, features and advantages of the present invention will be apparent from the following detailed descriptions of the various aspects of the invention in conjunction with reference to the following drawings, where.

DETAILED DESCRIPTION

Figure 1:
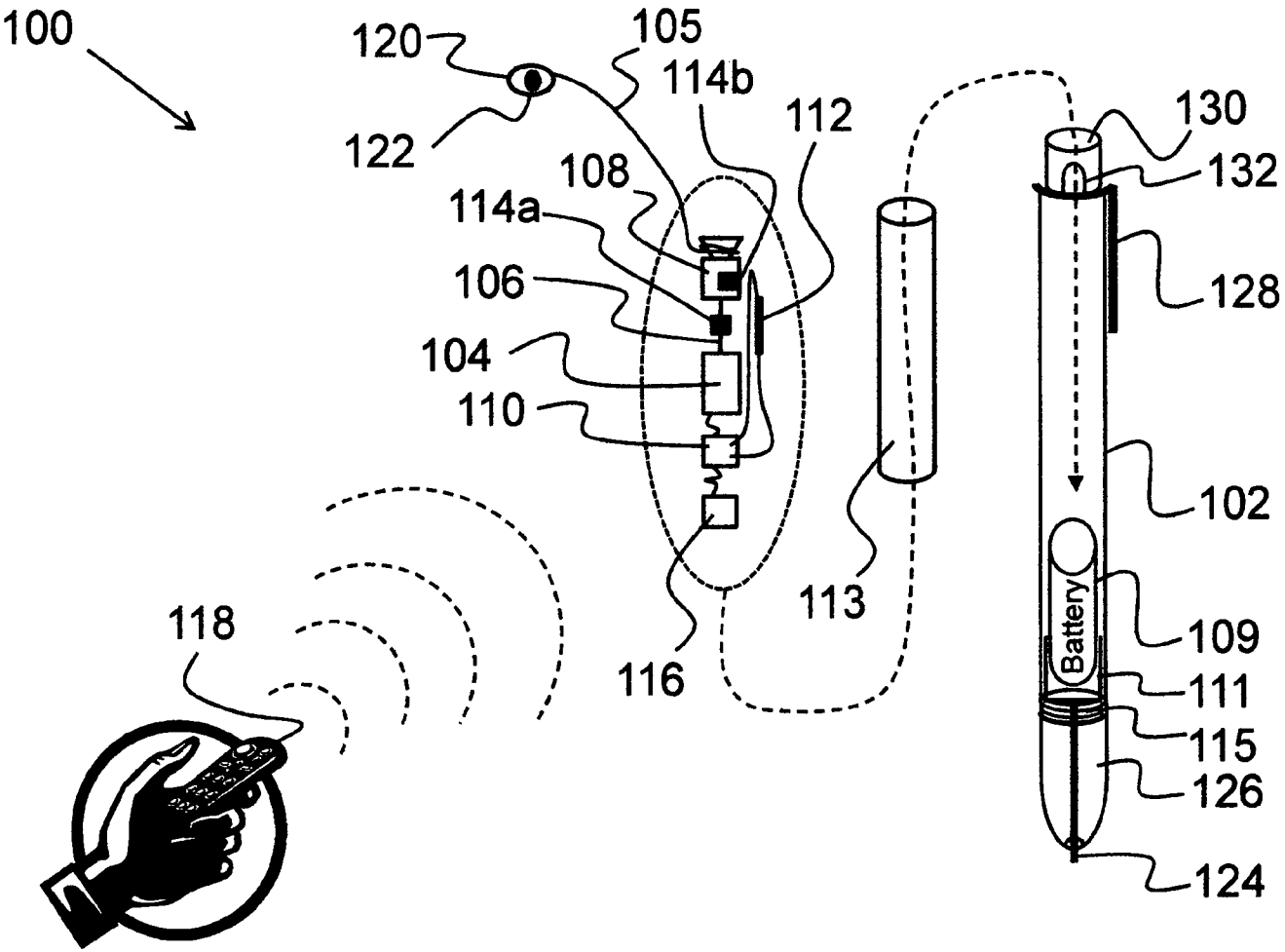
FIG. 1 is an exploded-view illustration of a miniature spooling apparatus according to the present invention.

The present invention relates to props and gimmicks used in the field of magic to create a variety of illusions and, more particularly, to an invisible thread reel prop that includes a miniature spooling apparatus with an internal motor that is operated by a switch. The following description is presented to enable one of ordinary skill in the art to make and use the invention and to incorporate it in the context of particular applications. Various modifications, as well as a variety of uses in different applications will be readily apparent to those skilled in the art, and the general principles defined herein may be applied to a wide range of embodiments. Thus, the present invention is not intended to be limited to the embodiments presented, but is to be accorded the widest scope consistent with the principles and novel features disclosed herein.

In the following detailed description, numerous specific details are set forth in order to provide a more thorough understanding of the present invention. However, it will be apparent to one skilled in the art that the present invention may be practiced without necessarily being limited to these specific details. In other instances, well-known structures and devices are shown in block diagram form, rather than in detail, in order to avoid obscuring the present invention.

The reader's attention is directed to all papers and documents which are filed concurrently with this specification and which are open to public inspection with this specification, and the contents of all such papers and documents are incorporated herein by reference. All the features disclosed in this specification, (including any accompanying claims, abstract, and drawings) may be replaced by alternative features serving the same, equivalent or similar purpose, unless expressly stated otherwise. Thus, unless expressly stated otherwise, each feature disclosed is only one example of a generic series of equivalent or similar features.

Furthermore, any element in a claim that does not explicitly state "means for" performing a specified function, or "step for" performing a specific function, is not to be interpreted as a "means" or "step" clause as specified in 35 U.S.C. Section 112, Paragraph 6. In particular, the use of "step of" or "act of" in the claims herein is not intended to invoke the provisions of 35 U.S.C. 112, Paragraph 6.

Please note, if used, the labels left, right, front, back, top, bottom, forward, reverse, clockwise and counter clockwise have been used for convenience purposes only and are not intended to imply any particular fixed direction. Instead, they are used to reflect relative locations and/or directions between various portions of an object.

DESCRIPTION

The present invention relates to a miniature spooling apparatus for use in the field of magic and illusions. The miniature spooling apparatus includes an invisible thread reel (ITR) that allows magicians and other users to conceal the device while controlling the invisible thread using a miniature electric motor. The miniature electric motor provides an even and consistent thread tension to the invisible thread when used to control the motion of small objects attached to the thread, thereby providing the illusion of levitation.

The illustrations and diagrams set out herein are for the purpose of detailing the structural, functional and aesthetic parameters embodied in this particular version of a normal-looking device, (such as writing pen) with a motorized thread reel hidden inside (such as within the cap of the writing pen).

It should be understood that although the present invention is illustrated as being used in a pen configuration, the present invention is not intended to be limited thereto as it can also be used separately without a pen and incorporated into virtually any item. Additionally, key design concepts such as the thread spooling mechanisms can also be successfully applied in other configurations, for instance a stand-alone version of the same reel could be combined with a hands-free controlling mechanism, and a larger power source. One example of a hands-free controlling mechanism that could be used in a variation of this device would be an electronic integrated circuit attached to the motor assembly that would remember and keep track of the number of rotations that the spooler completed while thread was unwinding from the spool, and when the thread was winding back to the spool the integrated circuit would shut the motor down when an equal number of reverse rotations was reached.

As shown in FIG. 1, the present invention is a miniature spooling apparatus 100. The miniature spooling apparatus includes a housing 102 having a miniature motor 104 attached with the housing 102. The miniature motor 104 is any suitable motor that can be used to spin a thread 105 (e.g., invisible thread) around a thread spooler, a non-limiting example of which includes a battery-powered, 12 millimeter electric motor. The motor 104 also provide a constant and even amount of tension when in operation.

The motor 104 includes a shaft 106 extending there from, with a mechanically powered spool 108 attached with the shaft 106. Thus, the motor 104 is connected with the spool 108 for powering the spool 108 and winding thread 105 around the spool 108. Rotational torque from the motor 104 is transferred through the spool 108 and into the thread 105 in the form of a continuous pulling force. The constant and even tension created in the thread 105 is vastly superior to operational parameters offered by any previous non-motorized devices. It should be noted that as the motor 104 attempts to reel in the thread 105, the user can pull against the motor 104 while the motor 104 is still turned on and actually pull thread 105 out against the motor's pulling force. Thus, as the user pulls the thread 105 out and the motor 104 attempts to reel in the thread 105, the thread is taut which provides a constant tension.

An integrated circuit 110 is electrically connected with the motor 104 to operate the motor 104. The integrated circuit 110 is housed within the housing 102 and is configured to start and stop the motor 104 (i.e., turn the motor off and on). The integrated circuit 110 is, for example, an integrated circuit that includes a memory and is capable of sending a start and stop signal to the motor 104. The integrated circuit 110 can include a pre-programmed memory, or be programmable such that a user can program their own commands into the integrated circuit 110. Although described as an integrated circuit 110, as can be appreciated by one skilled in the art, the component can be replace with any suitable mechanism or device capable of performing the same functions listed herein.

A power source 109 is attached with the housing 102 and electrically connected with both the integrated circuit 110 and motor 104 to power the motor 104. The power source 109 is any suitable source of energy that is operable for powering the motor 104. As a non-limiting example, the power source 109 is a 1.5 Volt battery that is encased within the housing 102. Also included is a battery holder 111. The battery holder 111 is positioned within the housing 102 operates to hold the power source 109 fixed in place within the housing 102.

A switch 112 is electrically connected with the integrated circuit 110 to send a signal (e.g., complete a circuit) to the integrated circuit 110. Upon receipt of the signal, the integrated circuit 110 either starts or stops the motor 104, depending upon the motor's 104 current operation. The switch 112 is any suitable switch that is capable of completing a circuit or otherwise sending a signal to a integrated circuit 110. As a non-limiting example, the switch 112 is a magnetic reed switch that is operable via a magnetic field. Other non-limiting examples of suitable switches include a timer mechanism and a motion activated switch. For example, if a motion activated switch, upon the user's body motion, the integrated circuit 110 will cause the motor 104 to turn on for a predetermined amount of time (or until the motion stops).

As noted above, in a desirable aspect, the switch 112 is a magnet reed switch that is electrically connected with the integrated circuit 110. To operate the switch 112, a magnet 114*a* and/or 114*b* is attached with the shaft 106 and/or the spool 108. As a non-limiting example, the magnet 114*a* can be wrapped around the shaft 106, with the shaft 106 positioned through the magnet 114*a*. As another non-limiting example, the magnet 114*b* is embedded within the spool 108. Thus, as a user manually pulls the thread 105 from the spool 108, this causes both the shaft 106 and spool 108 to rotate, which in turn rotates the magnet 114*b*. The magnetic reed switch 112 is attached within the housing 102 such that it is positioned proximate the magnet 114*a* and/or 114*b*. Thus, rotating the magnet 114*a* and/or 114*b* causes the magnetic field to shift which actuates the magnetic reed switch 112, which then completes a circuit which is detected by the integrated circuit 110 (as the integrated circuit 110 is always in a sleep mode while the motor 104 is off). The integrated circuit 110 then turns on the motor 104 which then begins winding the thread 105 around the spool 108.

The integrated circuit 110 can also be configured such that as the thread 105 is pulled slowly by the user, the motor 104 will remain off. However, as the user manually pulls the thread 105 at an increased speed, the integrated circuit 110 then turns on the motor 104. An advantage to this is that it allows a user to withdraw thread 105 while not causing the motor 104 to turn on. This effect can be caused by a program within the integrated circuit 110, or by the properties of the magnetic reed switch 112.

After the motor 104 has wound the thread 105 onto the spool 108, the spool 108 longer rotates and is in a freeze pattern (is still). After being still for a predetermined amount of time, the integrated circuit 110 then turns off the motor 104. As a non-limiting example, after the motor spool 108 (and thereby the motor 104) stops spinning for about five seconds, the integrated circuit 110 turns the motor 104 off.

Alternatively, integrated circuit 110 is configured to determine when and if the thread 105 breaks. When the thread 105 breaks, the motor 104 spins freely without any counter-pulling tension as provided by the user. Thus, when the motor 104 is rotating freely without any counter tension for a predetermined amount of time, the integrated circuit 110 is configured to turn the motor 104 off. As a non-limiting example, after the motor 104 has rotated freely for seven seconds, the integrated circuit 110 turns the motor off.

In another aspect, the present invention includes an internal housing 113. The internal housing 113 allows the motor 104, integrated circuit 110, and other components (e.g., receiver 116 described below) to be safely and tightly held within a single unit (i.e., the internal housing 113). In this aspect, the internal housing 113 with its components therein are then fit into the housing 102 to provide a secure and tight fit. The use of the internal housing 113 also assists in mass production as it results in a compact, single unit that can be easily incorporated into other units.

Although described as being used with a magnetic reed switch, one skilled in the art can appreciate that the present invention can also be operated remotely using a variety of devices. As a non-limiting example, the present invention also includes a wireless receiver 116 that is attached with the integrated circuit 110 for receiving a signal form a wireless transmitter 118. Thus, the integrated circuit 110 is configured to receive the signal from the wireless transmitter 118 and cause the motor 104 to turn on and/or off, thereby allowing a user to remotely control the miniature spooling apparatus 100. The wireless transmitter 118 can include an attachment means to allow the transmitter 118 to be secretly attached with different locations on the user's body, thereby concealing the item and allowing a user to secretly use the transmitter 118. For example, the transmitter 118 can include a small magnet, Velcro, or any other attachment means that allows the transmitter 118 to be attached with the user.

Another non-limiting example of a switch mechanism includes a remote-control toe-switch that is attached to the user's sock. In other words, the remote control transmitter 118 can be attached with the user's sock, calf, or otherwise concealed near the user's fee. The transmitter 118, in this aspect, is then wired to a toe-switch that is operated by a ball switch. In this aspect, there is a uniform piece of plastic with a piece of rubber that loops around the user's toe. Either positioned above or below the user's toe is the actual toe-switch (i.e., ball switch). Thus, once the user bends the toe, the switch is actuated to send the signal to the transmitter 118, which then sends the signal to the receiver 116, which then activates the motor 104.

In yet another aspect, the integrated circuit 110 can be programmed with a delay. For example, when the user activates the motor 104 using the wireless transmitter 118, there is a delay (e.g., three seconds) before the motor 104 begins turning the spool 108. For example, the user can click on a button on the wireless transmitter 118 which sends a signal to the integrated circuit 110. The integrated circuit 110, upon receiving the signal, incorporates a delay before actually turning on the motor 104.

In another aspect, the integrated circuit 110 is programmed to periodically turn the motor on and off. For example, a user can send a signal from the wireless transmitter 118, which causes integrated circuit 110 to turn the motor on and off which causes a bouncing effect of any object attached to the thread 105. As a more specifically example, the user could hold down a button on the transmitter 118 for a period of time (e.g., three seconds), after which the integrated circuit 110 begins turning the motor on and off for a period of time or until another signal is sent to the integrated circuit 110 to cause it to cease the bouncing operation.

Another aspect allows a user to adjust the speed and power of the motor 104. For example, the integrated circuit 110 is configured to allow a user to raise or lower the voltage of the motor 104. For example, using the transmitter 118, a user can send an adjustment signal which signals to the integrated circuit 110 to adjust the voltage of the motor 104.

In another aspect, the integrated circuit 110 can be configured to receive a time signal that is indicative of a run-time for the motor 104. For example, a user can engage the switch (e.g., transmitter 118) for a certain period of time (e.g., three seconds) and upon disengagement, the integrated circuit 110 turns on the motor for the same amount of time (e.g., three seconds).

In another aspect, the thread 105 includes wax 120 affixed with the thread 105 to indicate an end of the thread 105. Further, a small magnet 122 can be positioned within the wax 120 such that as the thread is wound upon the spool 108 and comes to an end of the thread 105, the small magnet 122 attached with a piece of metal (e.g., the housing 102) to prevent the thread 105 from getting completely drawn into the spool 108.

As mentioned above, the miniature spooling apparatus 100 is formed to simulate a non-descript item and thereby conceal its function to increase the effects of the levitation or animation illusion. As a non-limiting example, the present invention can be formed to appear and operate as a traditional ink pen.

In this aspect, the housing 102 is formed to resemble a barrel of a writing utensil with the miniature motor 104 and integrated circuit 110 encased therein. To add realism to the effect, a writing tip 124 that includes ink is attached with the housing 102. Due to the ink (or ink cartridge) therein, the writing tip 124 allows a user to write upon a surface. Additionally, twistable writing tip housing 126 is attached with the housing 102 and encases the writing tip 124 therein. Additionally, the writing tip housing 126 is optionally connected with threads 115 of the battery housing 111.

The writing tip housing 126 is detachably attachable to allow a user to change the ink cartridge or the battery. Additionally, the writing tip housing 126 is operable to extend or retract the writing tip 124. For example, the writing tip housing 126 can be twisted in one direction to extend the writing tip 124 beyond the writing tip housing 126, while twisting in the other direction retracts the writing tip 124 within the writing tip housing 126 to conceal the writing tip 124. The writing tip 124 is any suitable writing utensil capable of writing on a surface, a non-limiting example of which includes a ball point pen mechanism.

To further add to the realism of the pen or faux device, a pocket clip 128 is attached with the housing 102. The pocket clip 128 is formed of a rigid metal shaft that is covered by a plastic pocket protector. The clip 128 has a spring-like ability to snap back into position. This results in a firm grip that can be slid onto an article of clothing. The pocket clip 128 can also be used for attachment to any thin object as necessary.

In another aspect, the miniature spooling apparatus 100 includes a cover apparatus 130 for covering the spool 108. In this case, although not limited thereto, the cover apparatus 130 is formed to appear as a cap to a standard pen, thereby also adding to the realism of the device and further concealing the intended function of the device. The cover apparatus 130 includes an open end and is formed such that it covers a portion of the mechanically powered spool 108. The cover apparatus is attached with the housing 102 such that a space exists between the cover apparatus 130 and the spool 108 to allow for rotation of the spool 108 therein.

In another aspect, the spool 108 includes a rotational axis and the cover apparatus 130 is attached with the housing 102 such that it is rotatable in relation to the housing 102 about a rotational axis. Additionally, the cover apparatus 130 is attached with the housing 102 such that its rotational axis is approximately parallel to the rotational axis of the spool 108. Additionally, the cover apparatus 130 (e.g., cap) can rotate around the rotational axis to any suitable degree, a non-limiting example of which includes being rotatable 360 degrees. Further, as can be appreciated by one skilled in the art, the cover apparatus 130 can be attached with the housing 102 such that it may be easily removed and re-attached by user, thereby providing access to the spool 108 and allowing the user to change the spool 108 and/or thread.

In yet another aspect, a notch 132 is formed in the cover apparatus 130 such that when thread 105 is spooled from the spool, the thread 105 passes through the notch 132. All of the edges are smooth and rounded so the super-thin thread 105 used by the spool 108 is less likely to be cut. The notch 132 is wider at the base and narrows near the top in order to help the thread 105 into position. Although not limited thereto, in one aspect, rotation of the cover apparatus 130 allows a user to control a direction in which the thread 105 spools.

Additionally, as mentioned above, the miniature spooling apparatus 100 can be incorporated into a wide variety of devices, non-limiting examples of which include a watch, a small plastic tube, a bracelet, necklace pendant, etc.

In summary, the present invention is a miniature spooling apparatus that is incorporated into another item to conceal its functionality. The miniature spooling apparatus includes a motorized spool with a fine thread wrapped around the spool. Using the thread, a user can attach objects with the thread to provide the illusion of levitation or animation.

What is claimed is:

1. A miniature spooling apparatus, comprising;

a housing having a miniature motor attached with the housing, the miniature motor having a shaft extending therefrom, the miniature motor being a micro-motor with a size suitable to allow the miniature motor to be positioned within a cap of a writing pen;

a mechanically powered spool attached with the shaft of the miniature motor, the miniature motor being connected with the spool for powering the spool to wind invisible thread around the spool;

invisible thread wound around the spool, the invisible thread being a thin, monofilament thread;

an integrated circuit connected with the motor and configured to cause the motor to start winding the invisible thread around the spool and also configured to cause the motor to stop winding the invisible thread around the spool; and wherein the integrated circuit is configured to perform an operation selected from a group consisting of turning off the motor if the spool is still for a predetermined amount of time and turning off the motor if the motor is rotating freely for a predetermined amount of time.

2. A miniature spooling apparatus, comprising;

a housing having a miniature motor attached with the housing, the miniature motor having a shaft extending therefrom;

a mechanically powered spool attached with the shaft of the miniature motor, the miniature motor being connected with the spool for powering the spool to wind thread around the spool;

invisible thread wound around the spool, the invisible thread being a thin, monofilament thread;

an integrated circuit connected with the motor and configured to cause the motor to start winding the thread around the spool and also configured to cause the motor to stop winding the invisible thread around the spool;

wherein the integrated circuit is in a sleep mode while the motor is off and, when a user pulls the invisible thread from the spool which causes the shaft to rotate, the integrated circuit is configured to detect that the shaft is rotating which causes the integrated circuit to turn on the motor to cause the motor to begin winding invisible thread around the spool.

3. A miniature spooling apparatus as set forth in claim 2, wherein when the spool is still for a predetermined amount of time, the integrated circuit is configured to turn off the motor.

4. A miniature spooling apparatus as set forth in claim 3, wherein the integrated circuit is further configured to determine when the motor is rotating freely, such that as the motor rotates freely for a predetermined amount of time, the integrated circuit is configured to turn off the motor.

5. A miniature spooling apparatus as set forth in claim 4, wherein the housing is shaped to resemble a barrel of a writing utensil with the miniature motor and integrated circuit encased therein.

6. A miniature spooling apparatus as set forth in claim 5, further comprising a battery encased within the housing and connected with the integrated circuit for powering the integrated circuit and the miniature motor.

7. A miniature spooling apparatus as set forth in claim 6, further comprising a writing tip that is attached with the housing to allow a user to write upon a surface.

8. A miniature spooling apparatus as set forth in claim 7, further comprising a twistable writing tip housing for attaching with the housing and encasing the writing tip therein, the twistable writing tip housing being operable for extending the writing tip beyond the writing tip housing to allow a user to write with the writing tip and also for retracting the writing tip within the writing tip housing to conceal the writing tip.

9. A miniature spooling apparatus as set forth in claim 8, further comprising a cover apparatus with an open end, the cover apparatus being formed such that it covers a portion of the mechanically powered spool and being attached with the housing such that a space exists between the cover apparatus and the spool to allow for rotation of the spool therein;

wherein the spool includes a rotational axis and the cover apparatus is attached with the housing such that it is rotatable in relation to the housing about a rotational axis, and where the cover apparatus is attached with the housing such that its rotational axis is approximately parallel to the rotational axis of the spool; and wherein the notch is formed in the cover apparatus such that when thread is spooled from the spool and through the notch, rotation of the cover apparatus allows a user to control a direction in which the thread spools.

10. A miniature spooling apparatus as set forth in claim 2, further comprising a wireless receiver attached with the integrated circuit with the integrated circuit being configured to receive a signal from a wireless transmitter to cause the motor to turn on and off.

11. A miniature spooling apparatus, comprising;

a housing having a miniature motor attached with the housing, the miniature motor having a shaft extending therefrom;

a mechanically powered spool attached with the shaft of the miniature motor, the miniature motor being connected with the spool for powering the spool to wind thread around the spool; and an integrated circuit connected with the motor and configured to cause the motor to start winding the thread around the spool and also configured to cause the motor to stop winding the thread around the spool; and a writing tip that is attached with the housing to allow a user to write upon a surface.

12. A miniature spooling apparatus as set forth in claim 11, further comprising a twistable writing tip housing for attaching with the housing and encasing the writing tip therein, the twistable writing tip housing being operable for extending the writing tip beyond the writing tip housing to allow a user to write with the writing tip and also for retracting the writing tip within the writing tip housing to conceal the writing tip.

13. A miniature spooling apparatus, comprising:

a miniature motor, the miniature motor having a shaft extending therefrom;

a spool attached with the shaft of the miniature motor, the miniature motor being connected with the spool for powering the spool to wind invisible thread around the spool;

invisible thread wound around the spool, the invisible thread being a thin, monofilament thread;

an integrated circuit connected with the motor and configured to cause the motor to start winding the invisible thread around the spool and also configured to cause the motor to stop winding the invisible thread around the spool;

a toe-switch having a wireless transmitter for transmitting a wireless signal;

a wireless receiver attached with the integrated circuit for receiving the wireless signal and causing integrated circuit to activate the motor to cause the motor to power the spool to wind invisible thread around the spool; and wherein the toe-switch is operable for causing the integrated circuit to both start and stop winding the invisible thread around the spool.

14. A miniature spooling apparatus, comprising:

a miniature motor, the miniature motor having a shaft extending therefrom;

a mechanically powered spool attached with the shaft of the miniature motor, the miniature motor being connected with the spool for powering the spool to wind invisible thread around the spool;

invisible thread wound around the spool, the invisible thread being a thin, monofilament thread;

an integrated circuit connected with the motor and configured to cause the motor to start winding the invisible thread around the spool and also configured to cause the motor to stop winding the invisible thread around the spool; and wherein the integrated circuit is configured to perform a bouncing operation such that the integrated circuit causes the motor to repeatedly turn on and off until receiving a signal to cease the bouncing operation, whereby through the bouncing operation, a user can position an object on the invisible thread to generate an illusion that the object is dancing as the motor is repeatedly turned on and off.

15. A miniature spooling apparatus, comprising:

a miniature motor, the miniature motor having a shaft extending therefrom;

a spool attached with the shaft of the miniature motor, the miniature motor being connected with the spool for powering the spool to wind invisible thread around the spool;

invisible thread wound around the spool, the invisible thread being a thin, monofilament thread;

an integrated circuit connected with the motor and configured to cause the motor to start winding the thread around the spool and also configured to cause the motor to stop winding the thread around the spool; and wherein the integrated circuit is in a sleep mode while the motor is off and, wherein the integrated circuit is configured to detect that the shaft is rotating which causes the integrated circuit to turn on the motor to cause the motor to begin winding invisible thread around the spool; and wherein the integrated circuit is configured to detect when the shaft ceases rotating such that after having ceased rotating for a predetermined amount of time, the integrated circuit turns off the motor and returns to a sleep mode.

16. A miniature spooling apparatus, comprising:

a housing having a miniature motor attached with the housing, the miniature motor having a shaft extending therefrom;

a mechanically powered spool attached with the shaft of the miniature motor, the miniature motor being connected with the spool for powering the spool to wind thread around the spool;

invisible thread wound around the spool, the invisible thread being a thin, monofilament thread;

an integrated circuit connected with the motor and configured to cause the motor to start winding the thread around the spool and also configured to cause the motor to stop winding the thread around the spool;

wherein the integrated circuit is configured to perform an operation selected from a group consisting of turning off the motor if the spool is still for a predetermined amount of time and turning off the motor if the motor is rotating freely for a predetermined amount of time;

a toe-switch having a wireless transmitter for transmitting a wireless signal;

a wireless receiver attached with the integrated circuit for receiving the wireless signal and causing integrated circuit to activate the motor to cause the motor to power the spool to wind thread around the spool; and wherein the toe-switch is operable for causing the integrated circuit to both start and stop winding the thread around the spool;

wherein the integrated circuit is configured to perform a bouncing operation such that the integrated circuit causes the motor to repeatedly turn on and off until receiving a signal to cease the bouncing operation; and wherein the integrated circuit is in a sleep mode while the motor is off and, wherein the integrated circuit is configured to detect that the shaft is rotating which causes the integrated circuit to turn on the motor to cause the motor to begin winding thread around the spool.

* * * * *